US006695194B1

(12) United States Patent
Chang

(10) Patent No.: US 6,695,194 B1
(45) Date of Patent: Feb. 24, 2004

(54) ELECTRIC TRIGGER ASSEMBLY FOR STAPLE GUNS

(76) Inventor: Wen-Chou Chang, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 10/464,134

(22) Filed: Jun. 18, 2003

(30) Foreign Application Priority Data

Dec. 25, 2002 (TW) ..... 91137919 A

(51) Int. Cl.[7] ..... B25C 1/04
(52) U.S. Cl. ..... 227/8; 227/130
(58) Field of Search ..... 227/2, 8, 10, 9, 227/130; 123/46 SC

(56) References Cited

U.S. PATENT DOCUMENTS 5,687,899 A * 11/1997 Dohi et al. ..... 227/8
6,223,966 B1 * 5/2001 Nayrac et al. ..... 227/130
6,431,429 B1 * 8/2002 Canlas et al. ..... 227/8
6,533,156 B1 * 3/2003 Chang ..... 227/130
6,604,664 B2 * 8/2003 Robinson ..... 227/8

* cited by examiner

*Primary Examiner*—Scott A. Smith
(74) *Attorney, Agent, or Firm*—Charles E. Baxley

(57) ABSTRACT

A staple gun includes an electro-magnetic valve recevied in a recess in the handle and an opening communicates with the main passage in the handle and the recess. The electro-magnetic valve has a shaft which movably seals the opening. A sensor connected to a distal end of a nose of the staple gun, a circuit board, and the electro-magnetic valve are connection electrically. A button switch, a mold switch, an adjusting pulse switch and a battery set are connected to the circuit board so that the mold switch activates various independent circuits and controls a number of reciprocating movement of the shaft of the electro-magnetic valve.

8 Claims, 4 Drawing Sheets

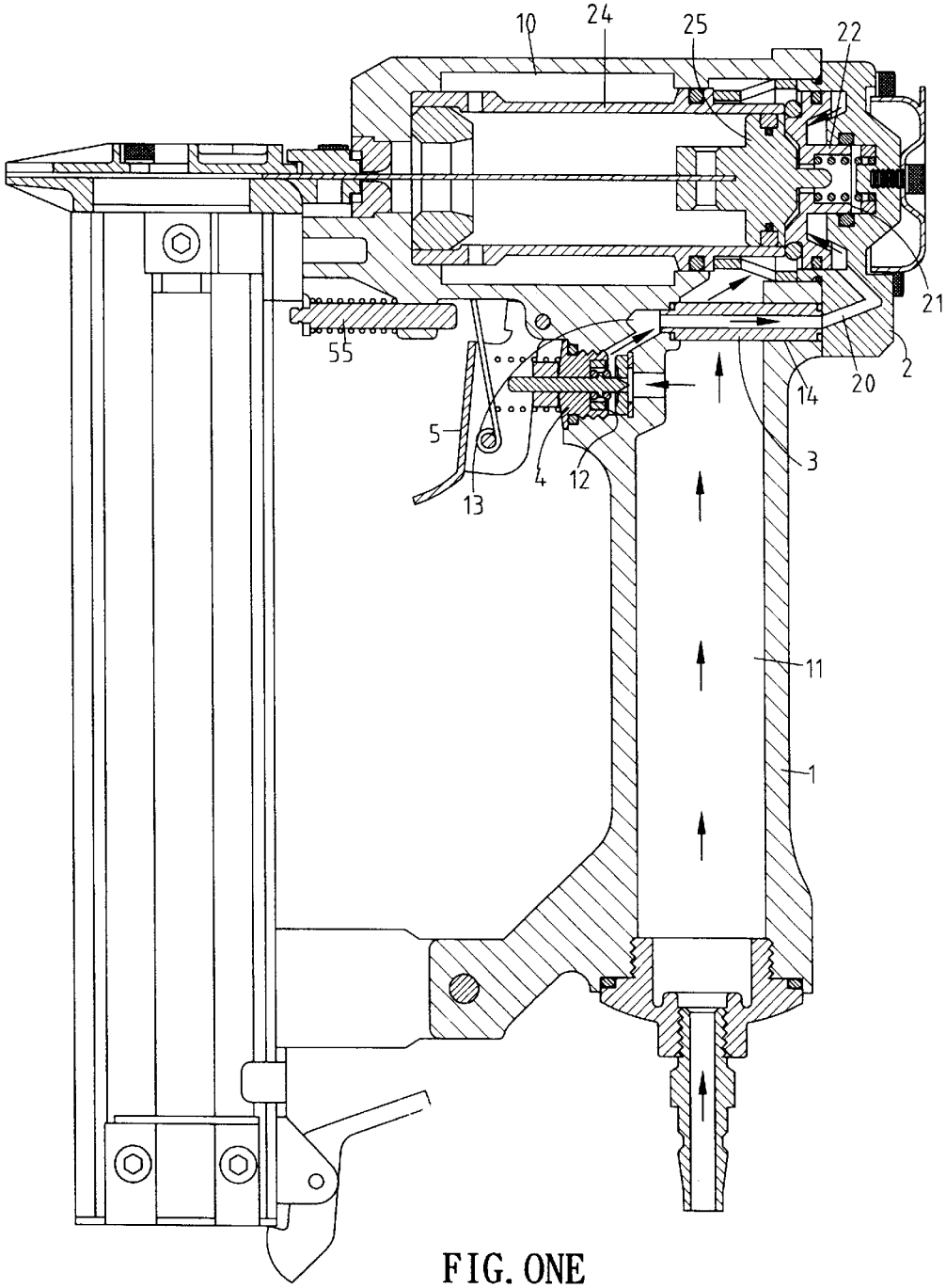
FIG. ONE
PRIOR ART

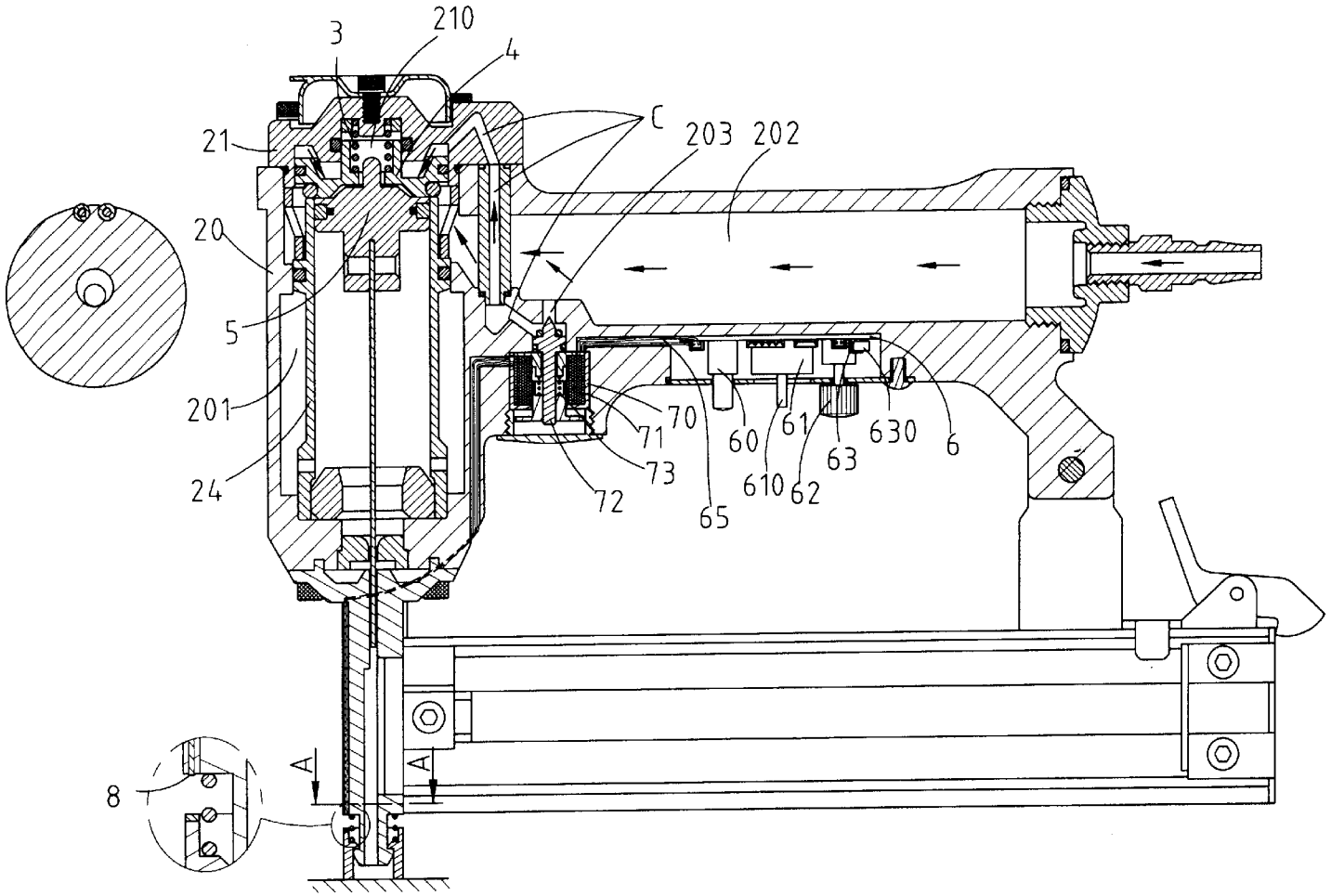
FIG. TWO

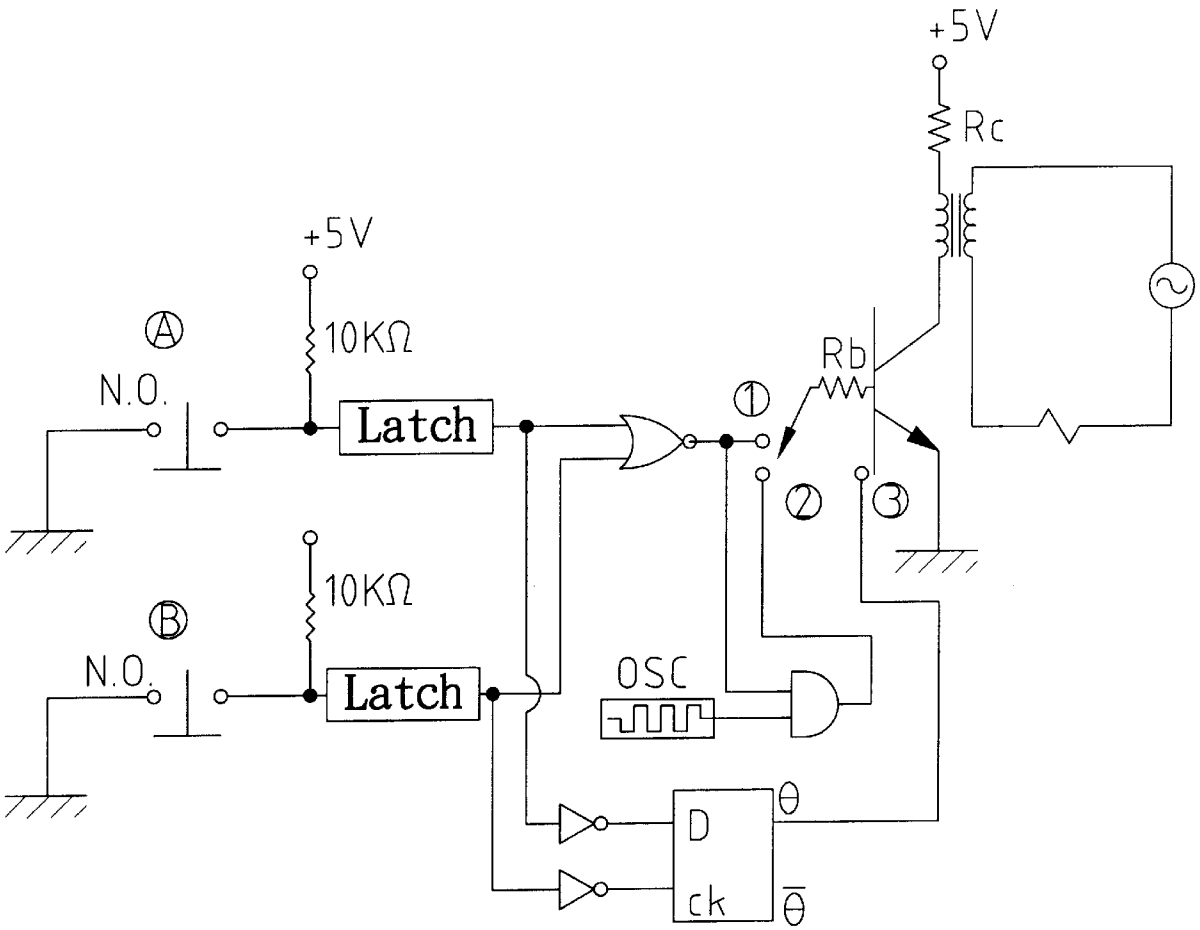
FIG. THREE

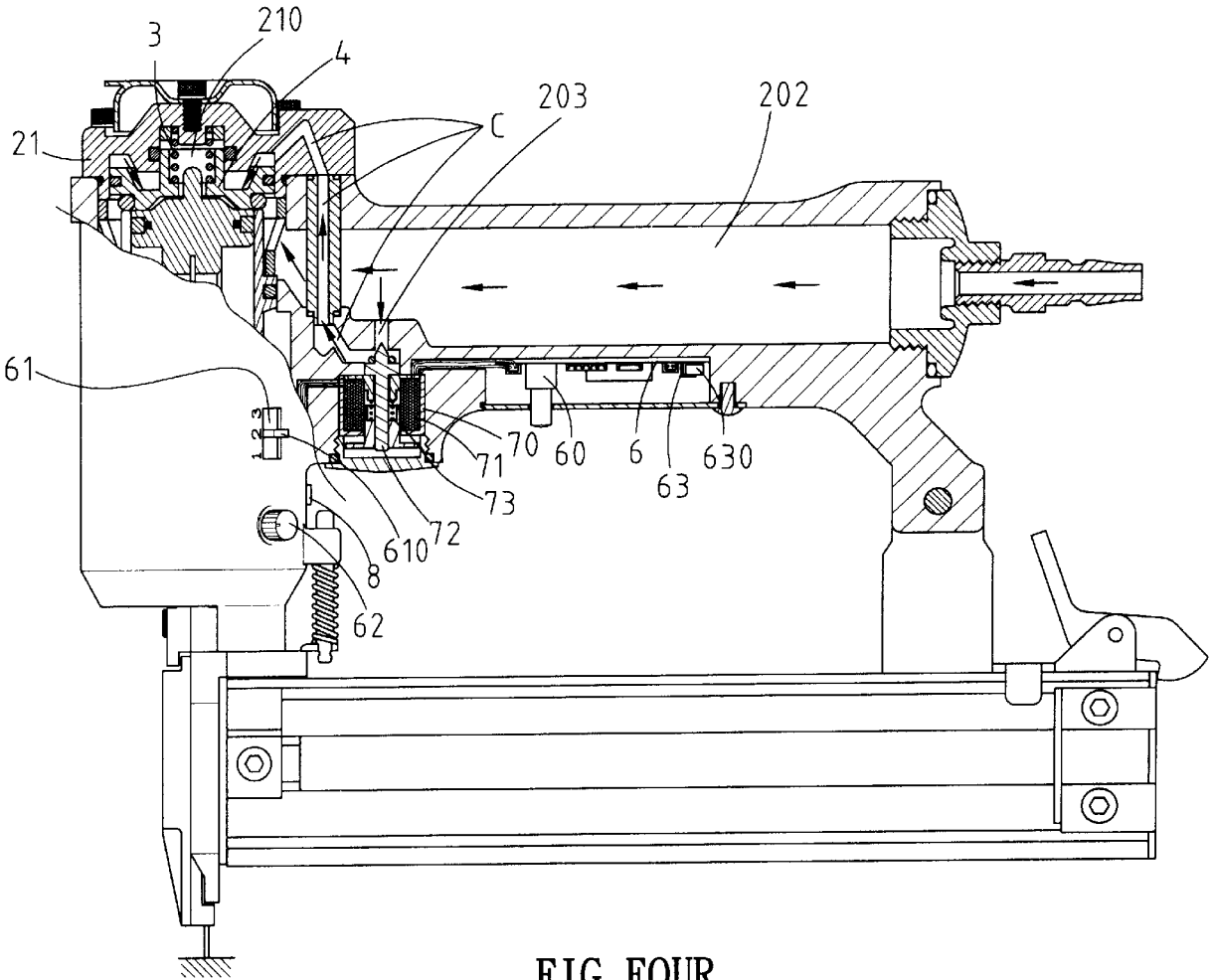
FIG. FOUR

ELECTRIC TRIGGER ASSEMBLY FOR STAPLE GUNS

FIELD OF THE INVENTION

The present invention relates to an electric control trigger assembly for staple guns and can be controlled by three molds.

BACKGROUND OF THE INVENTION

A conventional staple gun is shown in FIG. 1 and generally includes a handle 1 with a main passage 11 which is connected to a source of air from a compressor (not shown) and a barrel is connected to the handle 1 with a chamber 10 defined in the barrel. A cylinder 24 is received in the barrel 10 and an end mount assembly 2 is connected to a rear end of the barrel and a nose is connected to a front end of the barrel. An end cap 22 is movably connected to an inside of the end mount assembly 2 and biased by a spring 22 so as to seal an open end of the cylinder 24 in which a piston 25 is movably received in the cylinder 24. A magazine for receiving staples is connected to the nose. A recess 12 is defined in a wall of the handle 1 and a trigger valve 4 is received in the recess and can be activated by a trigger 5. Pressurized air may enter the recess 12 via a gap between the valve 4 and the opening in the wall of the handle 1 and enters a tube 3 engaged with a hole 14 defined in an inside of the handle 1 and a path 20. The pressurized air enters a space between the end cap 22 and the end mount assembly 2 via the path 20 so that the opening of the cylinder 24 sealed by the end cap 22 by the pressure in the space and the spring 21.

When a safety plate 55 is pushed toward the trigger 5 and the trigger 5 is squeezed the shaft of the trigger valve 4 is shifted to seal the opening communicating with the recess 12 and the pressure in the space mentioned above is reduced so that the end cap 22 is pushed toward the end mount assembly 2 by the pressure in the main passage 1. Once the end cap 22 is moved to open the open end of the cylinder 24, the piston 25 is moved to eject a staple by a plate connected to the piston 25 from the nose. Air in the cylinder 24 is pushed out via orifices defined through the wall of the cylinder 24 into the chamber 10. After shooting, the trigger 5 is released and the air in the chamber 10 enters the cylinder 24 again to push the piston 25 back to its original position. Simultaneously, air in the main passage 11 enters the tube 3 and the path 20 to assist the spring 21 to move the end cap 22 to seal the open end of the cylinder 24 again.

If the users want to have a continuous firing action, the trigger 5 has to be pressed all the time and then remove the safety plate 55 to the next object and press the safety plate 55 to shoot another staple. This could mis-fire the staple when the safety plate is unintentionally pushed.

The safety plate 55 and the trigger 5 are exposed and protrude from the barrel of the staple gun so that they could be tangled by other object or activated unintentionally.

The present invention intends to provide a staple gun wherein the trigger assembly is controlled by electric way so that the staple gun can be used in a continuously firing mold precisely.

SUMMARY OF THE INVENTION

In accordance with one aspect of the present invention, there is provided a staple gun which comprises a barrel with a chamber defined therein and a piston is movably received in a cylinder received in the chamber. A plate is connected to the piston and extends through a nose connected to a front end of the barrel. An end mount assembly is connected to a rear end of the barrel and an end cap movably seals an open end of the cylinder. A spring is biased between the end cap and an inside of the end mount assembly. A sensor is connected to a distal end of the nose and activated by a movement of a safety member movably mounted to the nose.

A handle is connected to the barrel and a main passage is defined in the handle. She main passage communicates with the chamber in the barrel and an opening is defined through a wall of the handle and communicates with a recess in the handle. An electro-magnetic valve is engaged with the recess and has a shaft which is movable to seal the opening. A circuit board is connected to the handle and electrically connected to the sensor and the electro-magnetic valve, wherein the circuit board, the sensor, and the electro-magnetic valve forms a circuit to control the movement of the shaft to seal the opening.

A button switch, a mold switch, an adjusting pulse switch and a battery set are connected to the circuit board. The mold switch activates various independent circuits and controls a number of reciprocating movement of the shaft of the electro-magnetic valve.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 1 is a cross sectional view to show a conventional staple gun;

FIG. 2 is a cross sectional view to show the staple gun of the present invention;

FIG. 3 shows the circuit for controlling the staple gun of the present invention, and FIG. 4 shows another embodiment of the staple gun of the present invention.

DETAILED DESCRIPTION OF THE PREFERRED EMBODIMENT

Referring to FIG. 2, the staple gun of the present invention comprises a barrel 20 with a chamber 201 defined therein and a cylinder 24 is received in the chamber 201. A piston 5 is movably received in the cylinder 24 and a plate is connected to the piston 5. A nose is connected to a front end of the barrel 20 and the plate extends through the nose. A sensor 8 movably mounted to the nose and a safety member is movably mounted to the nose so that when the safety member is pushed against an object, it contacts the sensor 8. A magazine for receiving staples is connected to the nose. An end mount assembly 21 is connected to a rear end of the barrel and an end cap 4 movably seals an open end of the cylinder 24. A spring 3 is biased between the end cap 4 and an inside of the end mount assembly 21.

A handle is integrally connected to the barrel 20 and a main passage 202 is defined in the handle. A fitting is connected to the handle so as to be connected to a compressor (not shown). The main passage 202 communicates with the chamber 201 in the barrel 20. An opening 203 is defined through a wall of the handle and communicates with a recess in the handle. An electro-magnetic valve 7 is engaged with the recess and has a shaft 72 which is able to be movable to seal the opening 203. The electro-magnetic valve 7 includes a casing 70 and coils 71 are received in the casing 70. A spring 73 is biased between an inside of the casing 70 and applies a force on the shaft 72 to normally maintain the shaft 72 at a position where the opening 203 is not sealed.

A circuit board 6 is connected to the handle and electrically connected to the sensor 8 and the electro-magnetic valve 7 by wires 65. The circuit board 6, the sensor 8, and the electro-magnetic valve 7 forms a circuit to control the movement of the shaft 72 to seal the opening 203. A button switch 60, a mold switch 61, an adjusting pulse switch 62 and a battery set 63 are connected to the circuit board, 6. The sensor 8 and the button switch 60 are connected in series and the adjusting pulse switch 62 is connected to the sensor 8 and the button switch 60 in parallel. The sensor 8 can be touch-type sensor, ordinary sensor, conductive plate, or protrusions.

When in use, the bar 610 of the mold switch 61 is pushed to its first position, the upper position, the switch 61 is electrically to the sensor 8, the button switch 60 and the electro-magnetic valve 7 in series. No matter which one of the sensor 8 or the button switch 60 is activated first, and the other is activated in the following step, the battery 630 of the battery set 63, the mold switch 61, the sensor 8, the mold switch 60 and the coil 71 in the electro-magnetic valve 7 form a circuit so that the shaft 72 of the electro-magnetic valve 7 is moved to seal the opening 203 so that pressurized air cannot enter the opening 203 and reach the space 210 between the end mount assembly 21 and the end cap 4 via the path "C". The end cap 4 is then pushed by the pressurized air coming from the main passage 202 so that the piston 5 is moved to eject a staple. After the force that pushes the shaft 72 is reduced, shaft 72 is disengaged from the opening 203 and the pressurized air enters the path "C" to the open end of the cylinder 24 is sealed again by the end cap 4.

When the bar 610 of the mold switch 61 is shifted to the middle, the second position, the mold switch 61 is electrically connected to the sensor 8, the adjusting pulse switch 62, the button switch 60 and the electro-magnetic valve 7 in series. The pulse frequency of the adjusting pulse switch 62 has to be set and then activating the sensor 8 and the button switch 60. The battery .630 of the battery set 63, the mold switch 61, the sensor 8, the adjusting pulse switch 62, the button switch 60 and the electro-magnetic valve 7 form a circuit so that the shaft 72 seals the opening 203 reciprocatingly so that the piston 5 moves reciprocatingly to continuously shoot the staples.

When the bar 610 of the mold switch 61 is shifted to the lower position, the third position, the mold switch 61 is electrically connected to the sensor 8, the diode 64, the button switch 60 and the electro-magnetic valve 7 in series. In this mold, the sensor 8 has to send a signal first and the button switch 60 is pushed to let the battery 630 of the battery set 63, the mold switch 61, the sensor 8, the adjusting pulse switch 62, the button switch 60 and the electro-magnetic valve 7 form a circuit so that the shaft 72 seals the opening 203, and the staple gun is operated as normal and standard procedures.

FIG. 4 shows an other embodiment of the present invention wherein the mold switch 61, the adjusting pulse switch 62 and the sensor 8 are connected to the barrel 20 respectively and connected to the sensor 8 and the button switch 60 of the circuit board 6 by wires 65 and in series. The adjusting pulse switch 62 is connected respectively to the diode 64 and the connected sensor 8 and the button switch 60 in parallel. Therefore, at least three independent circuits are obtained and the staple gun can be operated according to the control of the circuits.

While we have shown and described the embodiment in accordance with the present invention, it should be clear to those skilled in the art that further embodiments may be made without departing from the scope of the present invention.

What is claimed is:

1. A staple gun comprising:

a barrel with a chamber defined therein and a cylinder received in the chamber, a piston movably received in the cylinder and a plate connected to the piston, a nose connected to a front end of the barrel and the plate extending through the nose, an end mount assembly connected to a rear end of the barrel and an end cap movably sealing an open end of the cylinder, a spring biased between the end cap and an inside of the end mount assembly, a sensor is connected to a distal end of the nose, the sensor being activated by a movement of a safety member movably mounted to the nose;

a handle connected to the barrel and a main passage defined in the handle, the main passage communicating with the chamber in the barrel, an opening defined through a wall of the handle and communicating with a recess in the handle, an electro-magnetic valve engaged with the recess and having a shaft which is movable to seal the opening, a circuit board connected to the handle and electrically connected to the sensor and the electro-magnetic valve, wherein the circuit board, the sensor, and the electro-magnetic valve forms a circuit to control the movement of the shaft to seal the opening, and a button switch, a mold switch, an adjusting pulse switch and a battery set connected to the circuit board, the mold switch activating various independent circuits and controlling a number of reciprocating movement of the shaft of the electro-magnetic valve.

2. The staple gun as claimed in claim 1, wherein the sensor is electrically connected to the button switch in series.

3. The staple gun as claimed in claim 1, wherein the sensor is electrically connected the button switch in series and the adjusting pulse switch is electrically connected to the sensor and the button switch in parallel.

4. The staple gun as claimed in claim 1, wherein the electro-magnetic valve comprises a casing in which a coil, the shaft and the spring are received, the coil engaged in an inside of the casing and the shaft extending though the casing, the spring being biased between the casing and the shaft.

5. A staple gun comprising:

a barrel with a chamber defined therein and a cylinder received in the chamber, a piston movably received in the cylinder and a plate connected to the piston, a nose connected to a front end of the barrel and the plate extending through the nose, an end mount assembly connected to a rear end of the barrel and an end cap movably sealing an open end of the cylinder, a spring biased between the end cap and an inside of the end mount assembly, a sensor is connected to a distal end of the nose, the sensor being activated by a movement of a safety member movably mounted to the nose;

a handle connected to the barrel and a main passage defined in the handle, the main passage communicating with the chamber in the barrel, an opening defined through a wall of the handle and communicating with a recess in the handle, an electro-magnetic valve engaged with the recess and having a shaft which is movable to seal the opening, a circuit board connected to the handle and electrically connected to the sensor, the electro-magnetic valve, mold switch and adjusting pulse switch so as to move the shaft of the electro-magnetic valve to seal the opening, a button switch and a battery set connected to the circuit board, the mold switch activating various independent circuits and controlling a number of reciprocating movement of the shaft of the electro-magnetic valve.

6. The staple gun as claimed in claim 5, wherein the sensor is electrically connected to the button switch in series.

7. The staple gun as claimed in claim 5, wherein the sensor is electrically connected the button switch in series and the adjusting pulse switch is electrically connected to the sensor and the button switch in parallel.

8. The staple gun as claimed in claim 5, wherein the electro-magnetic valve comprises a casing in which a coil, the shaft and the spring are received, the coil engaged in an inside of the casing and the shaft extending though the casing, the spring being biased between the casing and the shaft.

* * * * *